US008261395B2

(12) United States Patent
Lazarre

(10) Patent No.: US 8,261,395 B2
(45) Date of Patent: Sep. 11, 2012

(54) ELECTRIC PAN SCRUBBER DEVICE

(76) Inventor: Wilfrid Lazarre, Wellington, FL (US)

( * ) Notice: Subject to any disclaimer, the term of this patent is extended or adjusted under 35 U.S.C. 154(b) by 0 days.

(21) Appl. No.: 13/301,121

(22) Filed: Nov. 21, 2011

(65) Prior Publication Data

US 2012/0186030 A1 Jul. 26, 2012

Related U.S. Application Data

(60) Provisional application No. 61/461,968, filed on Jan. 26, 2011.

(51) Int. Cl.
*A46B 13/04* (2006.01)

(52) U.S. Cl. ..... 15/29; 15/97.1

(58) Field of Classification Search ..... 15/29, 97.1; 401/281

See application file for complete search history.

(56) References Cited

U.S. PATENT DOCUMENTS 4,168,560 A * 9/1979 Doyel ..... 15/29
4,335,481 A * 6/1982 Slayman ..... 15/29
5,423,102 A * 6/1995 Madison ..... 15/22.2
5,450,646 A 9/1995 McHugh
5,649,334 A * 7/1997 Henriquez et al. ..... 15/29
5,881,418 A * 3/1999 Enoch ..... 15/101
6,170,107 B1 1/2001 George
6,170,108 B1 1/2001 Knight
6,981,291 B2 1/2006 McKay
7,503,715 B2 3/2009 Khubani
2004/0123410 A1 7/2004 Terry
2009/0188528 A1 7/2009 Jenkins

* cited by examiner

*Primary Examiner* — Randall Chin
(74) *Attorney, Agent, or Firm* — Daniel Boudwin; Alex Boyer

(57) ABSTRACT

Disclosed is a handheld, motorized cleaning device, comprising a removable rotary cleaning element, a fluid soap reservoir, an electric motor with drive means and a handle having an interior storage for battery power. The handle separates into segments to align a series of batteries, while its working end comprises a refillable reservoir of cleaning solution that is adapted to operate with a plurality of independent cleaning elements, without discharging and refilling between elements. An aperture along the base of the reservoir communicates cleaning solution through the cleaning element to develop lather while the cleaning element is rotated by the electric motor and drive means. The aperture opening is controlled by a rotational slide gate means at the base of the reservoir. In use, the cleaning element is placed in contact with a surface to physically remove built-up dirt and debris, while the soap further breaks down tougher grime and grease.

3 Claims, 3 Drawing Sheets

ELECTRIC PAN SCRUBBER DEVICE

CROSS REFERENCE TO RELATED APPLICATION

This application claims the benefit of U.S. Provisional Application No. 61/461,968 filed on Jan. 26, 2011, entitled "Pan Master."

BACKGROUND OF THE INVENTION

1. Field of the Invention

The present invention relates to powered cleaning devices. More specifically, the present invention relates to a handheld, rotary cleaning device for use cleaning dishes and similar work pieces using an electric drive means and a cleaning fluid reservoir connected directly to the handle of the device, allowing multiple cleaning elements to be utilized with the same reservoir.

Dish cleaning has traditionally been an exercise involving the physical removal of built-up food products, dirt and grease on dishes and pans, wherein a user is required to utilize a sponge or abrasive pad to remove unwanted elements in a scrubbing motion. This is typically completed in a kitchen sink or similar drainable area wherein a volume of soapy fluid is used, along with the aforementioned pads, to remove left-over dirt in a manual labor process. This operation can be tedious, physically exerting and time consuming. Further, thoroughly cooked-on dirt and grime can be particularly difficult to remove, requiring extensive scrubbing of the affected area. A more contemporary solution to personally scrubbing each individual dish and utensil is an automatic dishwasher device. This device allows a user to stack dirty dishes, utensils and drinking vessels into a closed cavity, wherein an automatic cleaning process involving high pressure jets of soap and water are utilized to separate and remove the dirt and food products thereon. The drawback to these devices is that those dishes having a particularly dirty or cooked-on residue may not be completely cleaned during the dishwater operation, requiring the user to manually wash these items, which eliminates any advantage the dishwasher device provides.

The present invention pertains to a handheld, rotary dish cleaning device that utilizes an powered cleaning element to provide a means of dirt removal, while requiring the user to hold both the work piece and the device during operation. The effort required by the user in this process is greatly reduced, as the device provides a continuously rotating cleaning means that is used to abrade and physically remove built-up dirt and food products. It is desired to disclose a device that allows a user to clean particularly dirty pans and dishes using a powered, handheld cleaning means, while less dirty articles may be cleaned in a traditional automatic dishwasher device. The present invention provides a cleaning solution reservoir that can be utilized with a plurality of cleaning element attachments, while the elements themselves rotate during use to scrub a local area until clean.

2. Description of the Prior Art

Motorized and powered cleaning devices have been disclosed in the prior art and are available to the public, providing means to aid a user cleaning tough dirt or food build-up using a rotating cleaning element. These devices have similar design elements for the purpose of cleaning tough dirt and cooked-on food products from a working surface. Most provide a motorized cleaning element, a handle for the user and in some instances, a soap reservoir for automatically dispensing soap or a cleaning solution. However, these devices fail to disclose a device with an attached soap reservoir that may be utilized with a plurality of consecutive cleaning elements, the reservoir having an aperture for communicating fluid to a variety of different cleaning implements through a common system and without requiring the user to fill up individual reservoirs on different cleaning implements. The devices in the art provide cleaning elements with integrated reservoirs, but these devices each require the user to fill the particular element's reservoir prior to use and do not allow the same reservoir to be utilized or controlled when changing cleaning elements.

In a search of related devices and those that are considered relevant to the present disclosure, several patented or published patent applications where found. These devices fail to describe the structure of the present invention, wherein a motorized cleaning device provides a plurality of cleaning attachments and an integrated cleaning fluid reservoir.

U.S. Patent Application Publication No. 2004/0123410 Terry is one such disclosure that describes a cleaning device for use in a kitchen sink having a rotating cleaning surface, powered by a drive shaft, joint assembly and a housing therearound. The cleaning surface comprises a sponge, pad, scourer or brush, while an electric motor powers the drive shaft and provides motive input for the rotating cleaning surface. The cleaning head base fitting has a plurality of attachment spikes for connection of a cleaning surface device. While disclosing a powered, rotating cleaning assembly with a removable cleaning appliance, the Terry disclosure fails to provide a reservoir of soap. The present invention provides a soap dispenser and refillable reservoir for direct application of soap onto a dish work piece. The ability to dispense small quantities of soap directly onto the device applicator working end, and directly onto an area of interest on a work piece, allows the device to adequately lather and break down built up dirt and grime thereon. The Terry device requires an external reservoir or quantity of soapy water for application, which can result in splashing or emersion of the device into a body of water, damaging its internal elements. Direct application of soap onto an already wet surface eliminates the need for a sink filled with cleaning solution and water, and limits the device's exposure to emersion.

U.S. Pat. No. 6,981,291 to McKay is another device that describes a powered cleaning apparatus having a removable cleaning element, a support handle with a cleaning element drive means, and a clamping mechanism carried on the support for attaching to the cleaning element. Further disclosed is an attachment to the support that contains a container for housing a volume of fluid, most notably dish washing detergent or soap. A fluid convenience means is disclosed being a depressible plunger or aperture in the container that transfers suds into the cleaning element. While useful for operating a powered cleaning device while cleaning dishes, the use of a reservoir within an attachment limits the storage capability and flexibility of the McKay device. If more than one attachment with a container is utilized, an amount of soap is required in each attachment, and switching therebetween is less efficient, as soap must be added to each. Cleaning fluid is therefore wasted. The present invention provides a housing with a fixed reservoir at its working end, wherein a volume of cleaning fluid may be stored for an indeterminate amount of time, and work with a plurality of cleaning attachments without relying on individual reservoirs attached to each subsequent attachment. The reservoir of the present invention provides a means to refill its contents, along with an aperture along its working end to dispense the fluid while in operation, directly onto the rotating cleaning element.

U.S. Pat. No. 6,170,107 to George describes a cleaning apparatus comprising a rotating brush device. The apparatus employs a handle that encloses a rechargeable battery, electric motor and a drive means for rotating a brush attachment at its working end. The brush attachment forms a central conduit through which soap may be dispense through radial orifices. The device may be used to clean a work piece using the rotating bristle or bush attachment, which soap is dispensed therefrom to lather the brush during operation. The structure of the brush attachment of George is a similar drawback to the design of McKay, wherein the attachments employ a reservoir or conduit for communicating soap or cleaning solution to the working elements of the device. These inventions therefore rely on the attachments to house cleaning solution, as opposed to providing a cleaning element that draws cleanings solution from a large reservoir within the handle of the device, as presented in the present invention.

U.S. Pat. No. 5,450,646 to McHugh describes a gun-shaped, portable pot washing tool having an electric drive motor, a waterproof battery and a brush attachment. The brush attachment is couple to a shaft to apply a rotation thereof for removing debris and grime from a pot using the motion of the brush as an abrasive force. The device further comprises a battery charger with a safety electric cord extending therefrom for charging the waterproof battery. The McHugh device discloses a gun-shaped, rotating brush tool for using cleaning pots. No means is disclosed for communicating soap to the brush attachment, and the design of the device substantially diverges from the disclosed invention.

U.S. Patent Publication No. 2009/0188528 to Junkins discloses an improved apparatus and method for cleaning a work surface using a plurality of rotating heads to apply a cleaning pressure thereto. Each head is adapted to rotate in opposite directions to further the scouring means and applied pressure to built-up or residual debris on a work surface. The opposite rotation of the cleaning heads is the primary utility of the Junkins disclosure. While adapted for its suited task and fulfilling a requirement in the art, this device does not describe the elements of the present invention, wherein a singular rotating drive means provides rotation of a cleaning element to affect dirt removal from a working surface. Regions of the cleaning element may be adapted to remain stationary or rotated with respect to one another; however it is not contemplated to restrict the present invention to such a method or apparatus.

U.S. Pat. No. 6,170,108 to Knight describes an electric back brush that provides an invigorating back scrub, comprising an elongated arm with a rotating brush head attached to a drive shaft. The drive shaft provides rotary oscillation to the brush head during operation. A soap reservoir compartment is formed within the elongated arm to store liquid soap. The Knight device provides a means to reach a user's back regions while showering and facilities cleaning using an oscillating brush head. The purpose of the device differs from the present invention, which utilizes a handle having a working end, the working end having a cleaning attachment secured thereto to facilitate a user depressing the head directly onto a dirty dish or similar work piece needing cleaning. The handle of the present invention is adapted to hold a plurality of batteries and a reservoir of cleaning solution.

U.S. Pat. No. 7,503,715 Khubani describes a handheld appliance having an elongated handle connected to a head assembly. A motor within the head assembly provides a rotational output shaft connected to a cleansing unit along the working end of the device. Within the attachable cleansing unit is a fluid reservoir for housing a cleaning fluid or soap, while the exterior of the unit employs a cleansing means such as a plurality of bristles or brushes. Similar to the McKay and George device, the Khubani device provides a removable cleaning element that houses a small amount of cleaning solution. While appropriate for back massagers, use with dishes or other scenario wherein multiple brush heads may be desired (scour pad, bristles, sponge), using a common reservoir and convenience means to facilitate the transference of cleaning fluid from the device to the separate cleaning elements is desired.

The devices in the prior art provide a motorized cleaning device, but lack the ability to integrate a universal soap reservoir for use with a plurality of cleaning implements, as opposed to individual reservoirs on each implement. The present invention is therefore submitted as being substantially divergent in design elements from the prior art and consequently it is clear that there is a need in the art for an improvement to existing handheld, motorized cleaning devices. In this regard the instant invention substantially fulfills these needs.

SUMMARY OF THE INVENTION

In view of the foregoing disadvantages inherent in the known types of handheld, motorized cleaning devices now present in the prior art, the present invention provides a new cleaning device wherein the same can be utilized for providing convenience for the user when cleaning a dirty surface of debris and cooked-on food product using a rotary tool, wherein a reservoir of liquid soap and dispensing means is provided for use with a plurality of engaged cleaning implements.

It is therefore an object of the present invention to provide a new and improved handheld, motorized cleaning device that has all of the advantages of the prior art and none of the disadvantages.

Another object of the present invention to provide a handheld, motorized rotary cleaning tool utilized to remove dirt and food products from a working surface using a removable cleaning element powered by an electric motor, wherein pressure exerted by the user and the rotary motion of the cleaning element provides a means for debris removal.

Another object of the present invention is to provide a liquid soap reservoir attached to the working end of the device handle, the reservoir having a fill aperture, a dispensing aperture and a means for controlling the dispensing aperture. The reservoir is attached to the handle of the device and is independent of the cleaning element in use.

A further object of the present invention is to provide a cleaning implement having a working end and a connection means to the device drive means, along with an aperture adapted to allow communication of liquid soap from the device reservoir and into the implement while in rotational operation.

Yet another object of the present invention is to provide a rotary cleaning device that is adapted to accommodate a cleaning implement using any bristle, brush or abrasive element for the purposes of physically removing debris or unwanted substances from a working surface.

A final object of the present invention is to provide a rotary cleaning tool that is battery powered and waterproof, allowing the user of the device in wet conditions and in kitchen sinks without risk of damage or electrocution risk to the user.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
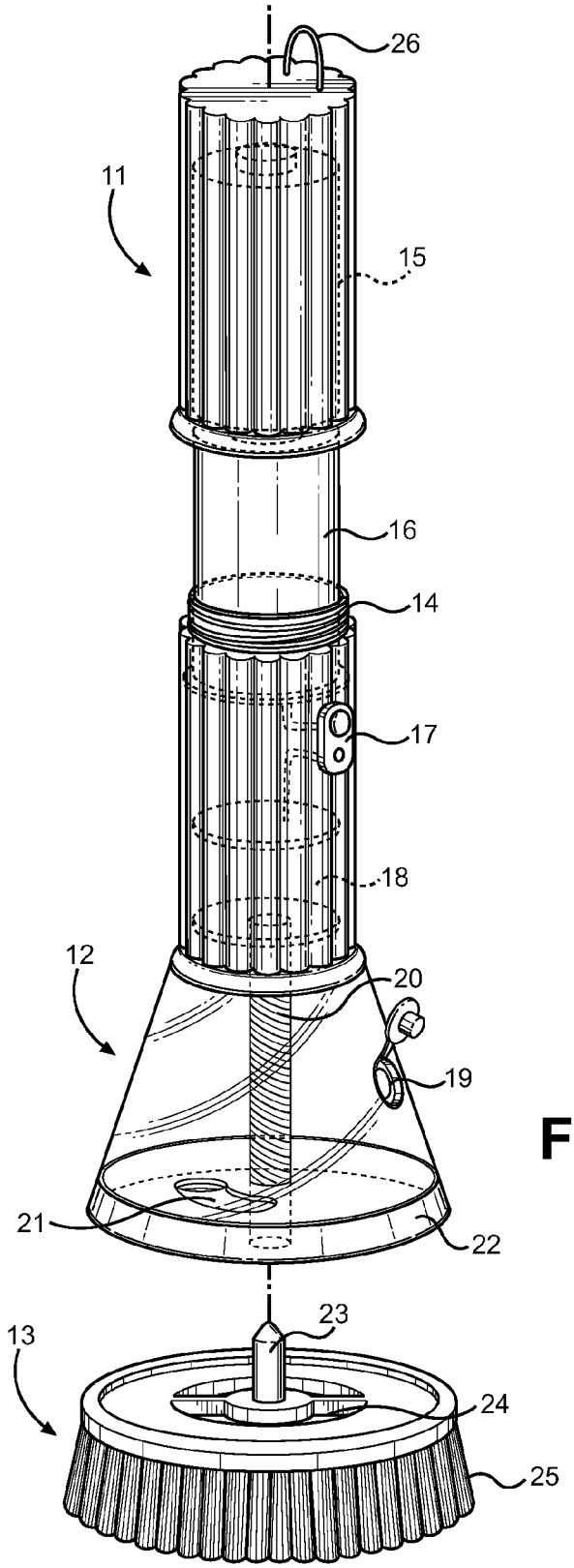
FIG. 1 shows an exploded perspective view of the present invention.

Reference is made herein to the attached drawings. Like reference numerals are used throughout the drawings to depict like or similar elements of the handheld, motorized cleaning device. For the purposes of presenting a brief and clear description of the present invention, the preferred embodiment will be discussed as used for aiding a user manually cleaning debris and unwanted articles from a working surface. The figures are intended for representative purposes only and should not be considered to be limiting in any respect.

Referring now to FIG. 1, there is shown an exploded, frontal perspective view of the handheld cleaning device of the present invention. The device comprises a handle 11, a fluid soap reservoir 12, a drive shaft 20 and a cleaning implement 13. The handle 11 is adapted for gripping by a user with a single hand and provides a means for operating the drive means via a power switch 17. Within the cavity of the handle 11 is provided a watertight enclosure for imbedded power in the form of a plurality of batteries 15, 16, an electric drive motor 18 and any necessary circuitry or wiring for facilitating the operation of the motor. The cavity of the handle 11 is accessible via a screw engagement at its center or at its first distal end, wherein the batteries may be replaced when necessary. Power from the batteries 15, 16 drives an electric motor 18 when the power switch is in a closed position, routing current from the batteries and into the motor 18 for driving a driveshaft 20 that routes through the soap reservoir and to a cleaning implement 13 at the device working end.

A fluid soap or cleaning solution reservoir is connected to the second end of the handle, between the area handle 11 and the cleaning implement 13. This reservoir is provided to house a volume of liquid soap or similar cleaner and dispense a quantity thereof during operation of the motor and subsequent rotation of the cleaning implement 13. At the base of the reservoir is a dispensing aperture 21 and a closure means 22 for controlling the aperture. In an exemplary embodiment, the closure means 22 provides a rotational slide gate that allows the user to rotate a cylindrical base, which opens or closes the aperture, and therefore controls whether fluid may communicate from the reservoir 12 and through the aperture 21. As the drive shaft 20 rotates the cleaning implement, fluid soap is drawn through the open aperture 21 and into an opening 24 at the base of the cleaning implement. The cleaning implement may comprise a number of different abrasive or scrubbing designs features; however those requiring soap or cleaning solution employ an open base for soap to flow from the reservoir and onto the cleaning implement working end 25. In the case of pan or dish cleaning, the working end 25 of the implement may be wet from kitchen sink water, the incoming soap creates a lather within the implement 13 for greater cleaning ability.

The reservoir 12 may be refilled when necessary via fill hole 19 along its sidewall. The reservoir is preferably transparent to allow a user to determine the level of soap therein, and determine when refilling is required. The reservoir is fixed to the second end of the handle, such that it may contain a volume of cleaning solution or soap, independent of the type of cleaning implement 13 being utilized at a given time. The reservoir reduces time required when changing between a sponge implement and a scrubber implement, providing a ready supply of soap for each device in use. The user may further close the aperture 21 in the reservoir to cease the flow of soap therethrough during operation, or when changing between implements 13, particularly when a replacement implement may not require any cleaning solution or soap later.

The cleaning implement 13 is a removably attachable device adapted to provide a cleaning working end that utilizes the rotary motion provided by the drive means 20 for abrasively or frictionally removing dirt and debris from a working surface. The implement 13 engages the drive shaft 20 via the implement shaft 23 that affixes thereto through the base of the reservoir 12. Once connection is established, rotation of the driveshaft 20 rotates the cleaning implement 13 at a corresponding rotational speed. It may be desirable to incorporate a multi-speed electric motor within the handle of the device, allowing the cleaning implement 13 to spin at different speeds according to a user's cleaning needs, as determined by an appropriate power switch 17. A further element along the distal end of the handle may include a hook 26 or attachment means that allows the device to be suspended when not in use.

Figure 2:
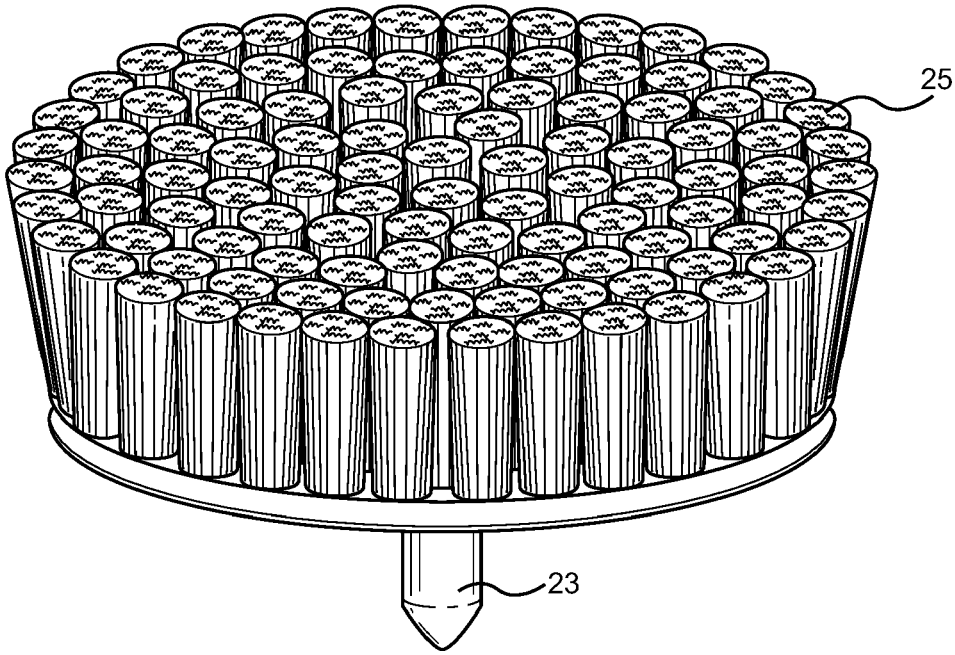
FIG. 2 shows an underside perspective view of a particular cleaning implement.
Figure 3:
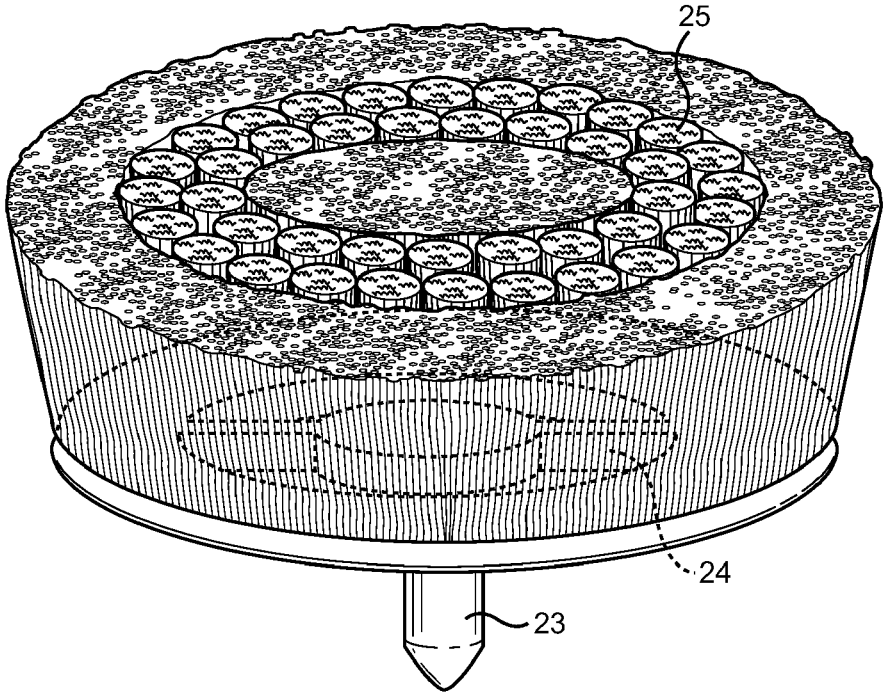
FIG. 3 shows an underside perspective view of a second cleaning implement.

Referring now to FIGS. 2 and 3, there are shown two embodiments of the present invention cleaning implement. The cleaning implement comprises a working end having an abrasive, sponge or similar cleaning means 25 attached to a base structure, along with a second end adapted to attach to the drive means of the present invention. The drive shaft connector between the drive means and the cleaning implement comprises a shaft 23 that allows transfer of rotation between the shaft and the implement. The base of the cleaning implement aligns with the end of the reservoir when connected, allowing free rotation and no interference. The exact design of the cleaning means 25 is not desired to be limited to a specific set of bristles, sponges or scouring pads, but rather it is designed to disclose functional examples that are contemplated for use as a rotary cleaning implement. For those implements and applications requiring a cleaning solution or lather of soap, an opening through the base 24 of the implement is provided to allow communication of fluid therethrough and onto the cleaning means 25. As the device is spun and compressed against a working surface, the soap will begin to lather, furthering the ability of the device to remove cooked-on or hardened debris.

Figure 4:
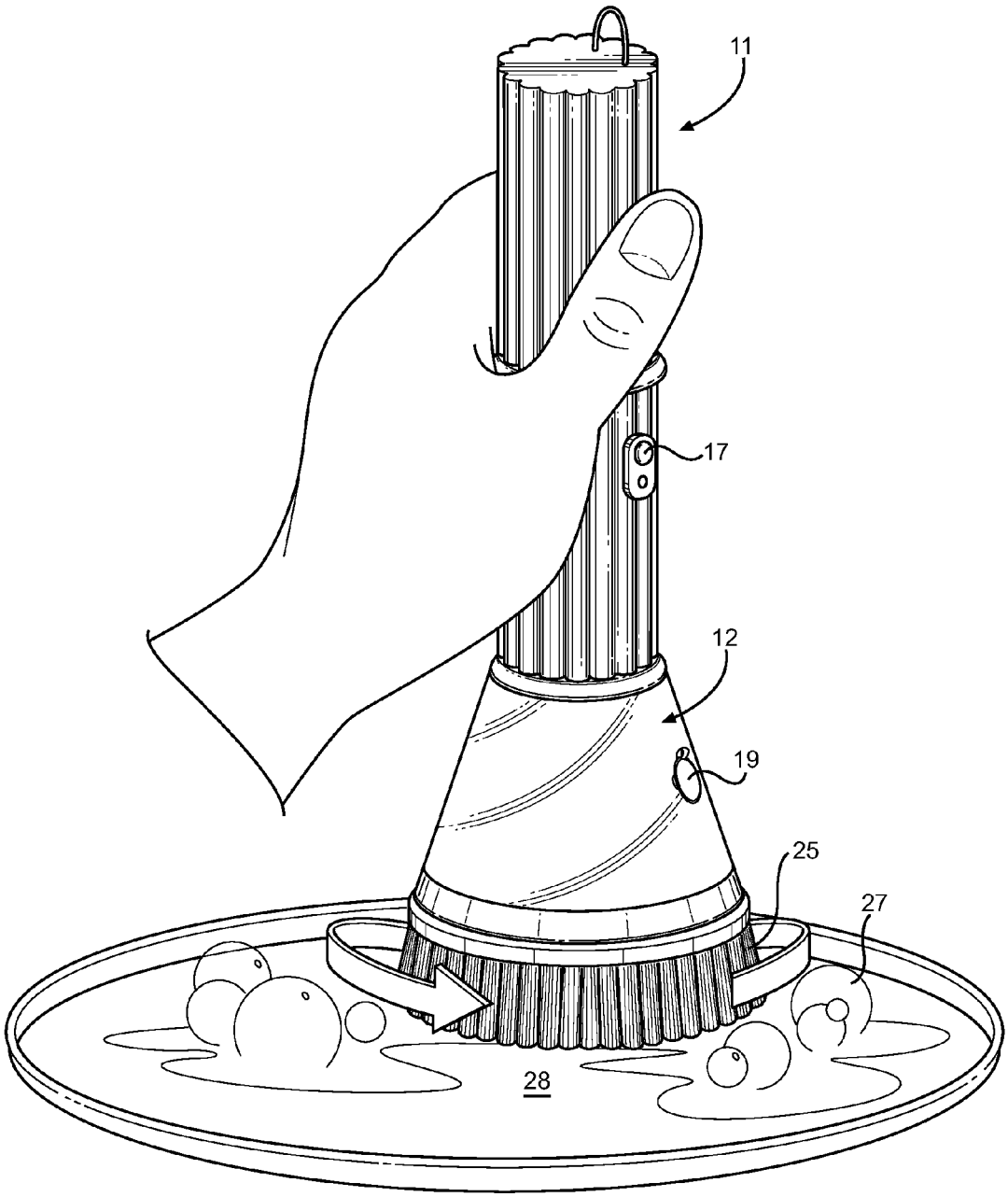
FIG. 4 shows the present invention in a working position, cleaning a working surface.

Referring now to FIG. 4, there is shown a perspective view of the present invention in a working position, wherein the cleaning means 25 of the device are pressed against a working surface 28 to remove dirt and debris therefrom, without requiring the user to physically the surface. The fill hole 19 of the reservoir 12 is engaged to prevent cleaning solution from exiting, while the power switch 17 is engaged to allow current to flow from the internal batteries and to the electric motor, powering the cleaning implement. Soap is discharged from the reservoir and through he cleaning implement, creating a lather 27 when mixed with water on the working surface 28.

In use, an individual grips the handle 11 and depresses the working end of the device against a working surface 28, applying a normal force thereagainst. The force exerted onto the working surface 28 allows the cleaning implement to create a higher degree of friction and abrasive force against stuck-on or cook-on debris requiring removal. The user may move the device along the entire area of the working surface, allowing the cleaning means 25 to actively remove any unwanted debris. Once cleaned, the dish or work piece may then be rinsed to remove any lather or soap residue.

Overall, the device provides a means to clean an article using a rotary cleaning implement, wherein a plurality of implements may be utilized without altering the ability of the device to dispense a volume of soap. The soap dispensing means may be opened or closed as required, and the reservoir may be refilled when the supply has been exhausted. Use of the present invention provides a user with a convenient means of cleaning pots, pans and other articles, without requiring the user to manually scrub the article with a pad or scrubber. The drive means provides the work required to rotate the cleaning implement, while the added force of the user and the motion of the device over the article surface provides a thorough cleaning thereof.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotary cleaning device, comprising:

a handle, a fluid soap reservoir, a detachable cleaning implement and a rotary drive means;

said handle having a first and second end, said reservoir attached to said handle second end;

said rotary drive means comprising an electric motor powered by battery power within said handle and controlled by an external power switch, said motor rotating a drive shaft through said reservoir and in connection with said cleaning implement;

said reservoir having an internal volume for storage of fluid cleaning solution, a fill hole for replenishing said solution, and a dispensing aperture at a reservoir base in connection with said cleaning implement;

said dispensing aperture comprises a rotatable slide gate, wherein said reservoir base is rotatable to open or close said aperture, and wherein said dispensing aperture controls the fluid flow from said reservoir to said cleaning implement.

2. The rotary cleaning device of claim 1, wherein said cleaning implement further comprises a base structure supporting a plurality of cleaning elements, a drive shaft connector and an opening through said base structure that aligns with said dispensing aperture when in use, allowing communication of cleaning solution through said base and to said cleaning elements.

3. The rotary cleaning device of claim 1, wherein said power switch includes a plurality of operating speeds for said electric motor.

* * * * *